US008490262B2

(12) United States Patent
Monyak et al.

(10) Patent No.: US 8,490,262 B2
(45) Date of Patent: Jul. 23, 2013

(54) RETAINING CLIP INSTALLATION AND REMOVAL TOOL

(75) Inventors: Kenneth Monyak, Abingdon, VA (US); Joseph Fader, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 648 days.

(21) Appl. No.: 12/651,541

(22) Filed: Jan. 4, 2010

(65) Prior Publication Data

US 2010/0192345 A1 Aug. 5, 2010

Related U.S. Application Data

(60) Provisional application No. 61/148,462, filed on Jan. 30, 2009.

(51) Int. Cl.
*B25B 27/20* (2006.01)
*B25B 31/00* (2006.01)

(52) U.S. Cl.
USPC ..... 29/243.56; 29/270; 29/229; 254/25

(58) Field of Classification Search
USPC ..... 254/121, 133 R, 25; 29/225, 229, 29/243.56, 244–280; 81/485, 486; 269/8
See application file for complete search history.

(56) References Cited

U.S. PATENT DOCUMENTS

| | | | | | |
|---|---|---|---|---|---|
| 1,344,619 | A | * | 6/1920 | Colvin | 29/267 |
| 1,903,557 | A | * | 4/1933 | Swoyer | 254/25 |
| 2,272,355 | A | * | 2/1942 | Schnell | 81/487 |
| 2,272,362 | A | * | 2/1942 | Barker | 254/25 |
| 2,470,309 | A | * | 5/1949 | Hepp | 81/486 |
| 2,483,379 | A | * | 9/1949 | Brell | 29/229 |
| 2,545,027 | A | * | 3/1951 | Grimm | 254/25 |
| 3,112,560 | A | * | 12/1963 | Wagoner | 29/229 |
| 3,470,600 | A | * | 10/1969 | Hosbach | 29/243.57 |
| 3,728,775 | A | * | 4/1973 | Hosbach | 29/243.57 |
| 3,957,307 | A | * | 5/1976 | Varda | 299/106 |
| 4,649,613 | A | * | 3/1987 | Bednarik | 29/253 |
| 4,942,655 | A | * | 7/1990 | Buzzelli | 29/229 |
| 5,720,528 | A | | 2/1998 | Ritchey | |
| 6,125,517 | A | * | 10/2000 | Yu | 29/229 |
| 6,212,746 | B1 | * | 4/2001 | Cooks, Jr. | 29/243.56 |
| 6,428,110 | B1 | | 8/2002 | Ritchey et al. | |
| 7,089,640 | B2 | * | 8/2006 | Tanaka et al. | 29/229 |
| 7,210,219 | B2 | * | 5/2007 | Thal | 29/709 |
| 7,210,745 | B2 | | 5/2007 | Ritchey | |
| 2009/0000096 | A1 | * | 1/2009 | Blok | 29/270 |

OTHER PUBLICATIONS

"Chain and Wheel Trenching Tools," Kennametal Catalog B06-8(15) p. 36, (2006).

* cited by examiner

*Primary Examiner* — Lee D Wilson
*Assistant Examiner* — Tyrone V Hall, Jr.
(74) *Attorney, Agent, or Firm* — Morgan, Lewis & Bockius LLP

(57) ABSTRACT

A hand tool which features a self-aligning recessed seating feature for easy installation of retaining clips onto the groove of the shank of mining and trenching picks. The location and orientation toward the first end of the body of the tool of the recessed seating feature allows for easy installation from either the left or right side of the holder. The tool includes two prongs located at the same end of the tool as the recessed seating feature. The end surfaces of the two prongs correspond in shape and/or orientation to the contact surfaces of a retaining clip to improve removal of retaining clips from the groove of the shank of mining and trenching picks.

17 Claims, 5 Drawing Sheets

RETAINING CLIP INSTALLATION AND REMOVAL TOOL

RELATED APPLICATION DATA

This application claims priority under 35 U.S.C. §119(e) to U.S. Provisional Application No. 61/148,462, filed Jan. 30, 2009, the entire contents of which are incorporated herein by reference.

FIELD

The present disclosure relates to a tool to install and remove retaining clips used with tool picks, such as mining and trenching picks. In particular, a tool containing a recessed seating feature to facilitate holding the retaining clip during installation and two prongs with surfaces that mate in surface contact to contacting surfaces on the retaining clip during removal.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Externally retained tool picks, such as mining and trenching picks, are conventional for the mechanical excavation of rocks and minerals. Such tool picks include a head, which contacts rocks and minerals during excavation, and a shank, which is mounted in a holder. A retainer, which can come in several forms, is positioned about the shank of the tool pick and retains the tool pick in the holder while also allowing rotation of the tool pick. Typically, the retainer uses spring-like behavior to allow the retainer to be placed over and retained about the shank.

Tool picks mounted in blocks can have a shank that protrudes from an end of a mounting bore. The shank can have a recess, such as a groove, which receives a retaining element. The retaining element is conventionally a spring steel having a C-shape, and is held in place in the recess by spring forces. The radial size of the retaining clip positions sides of the retaining clip in contact with the surface of the block to prevent the tool pick from being removed from the block.

To install retaining clips, such as a c-clip, a force is required to press the retaining clip into the groove. When the retaining clip is pressed into the groove, the ends will bend outwardly from each other so as to enable the retaining clip to snap into place. When the retaining clip is properly installed on the shank, an inner surface of the curved portion bears upon the groove to prevent further transverse movement of the retaining clip relative to the shank. To remove the clip, a force can be applied to the ends of the retaining clip to push the retaining clip off the groove.

Retaining clips can be difficult to install and remove from the groove in the shank. This is due, at least in part, to the limited access behind the block, the required spring forces to overcome in order to mount the retaining clip, and the awkwardness associated with positioning and applying a requisite installing and removing force to the retaining clip in an edge-on manner, including in the plane of the retaining element.

A typical tool 10 currently used for installing and removing c-clip style retainers from tool picks is shown in FIGS. 1-3. These tools contain a body including a first end 20 containing two prongs 22. To remove the c-clip 40, the user aligns the end surfaces 24 of the prongs on the tool with portions 42 of the c-clip as shown in FIG. 2, and strikes the opposite end 30 of the tool with a hammer. The square end surfaces 24 on the tool are very difficult to align with the angled end surfaces 42 of a c-clip.

Existing tool designs for installing c-clips employ a smooth cut-away radius 32, an example of which is shown in FIG. 3. The depth of the cut-away radius 32 matches the outside diameter of the c-clip 40, but the radius of curvature of the cut-away 32 fails to correspond to the radius of curvature of the back surface 44 of the c-clip. To assemble the c-clip 40 onto a tool pick 50, the user must align the c-clip 40 on the groove 54 at the rear 52 of the tool pick while simultaneously aligning the radius 32 on the tool with the back surface 44 of the c-clip. Also, the cut-away radius 32 is located near the second end 30 of the tool, and opens in a direction transverse to either end of the tool. Once everything is aligned, the user must carefully strike the side of the tool 10 opposite the cut-away radius 32 with a hammer. Due to the force required, the elastic memory of these retainers, and the alignment difficulties during installation, many are prone to "fly" in any given direction. This can make the installation of the retainers a safety hazard on the job site.

Examples of tools for installing and removing retainers are shown in U.S. Pat. Nos. 5,720,528; 6,428,110; and 7,210,745. However, none of these prior art solutions addressed or improved the tool-to-retainer contact area to improve performance of the tool during removal of the retainer. Also, none of these prior art solutions provide self-alignment of the retainer in the tool during installation of the retainer, to alleviate the difficulty of aligning the retainer in the recessed seating feature during installation.

SUMMARY

To improve the functionality and safety aspects, a tool was developed to position two prongs and a recessed seating feature in the same end to allow installation and removal force to be applied in the same longitudinal direction. The two prongs and recessed seating feature provide self-alignment to the retainer during both removal and installation.

An exemplary installation and removal tool for installing and removing a retaining clip comprises a body including a first end and a second end, wherein the first end includes two prongs separated by a distance and a recessed seating feature, and wherein the recess seating feature comprises an upper surface and a lower surface joined by a concave surface recessed into the tool.

An exemplary tool pick retaining clip installation and removal system comprises a retaining clip to fit within a groove in a shank of a tool pick, and an installation and removal tool for installing and removing the retaining clip from the groove comprising a body including a first end and a second end, wherein the first end includes two prongs separated by a distance and a recessed seating feature, wherein the distance between the two prongs is such that simultaneously a portion of an end surface of a first prong contacts a portion of a first contact surface of the retaining clip and a portion of an end surface of a second prong contacts a portion of a second contact surface of the retaining clip, wherein the recess seating feature includes an upper surface and a lower surface joined by a concave surface recessed into the body of the tool, and wherein the distance between the upper and lower surfaces is approximately the same as the thickness of the retaining clip.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1:
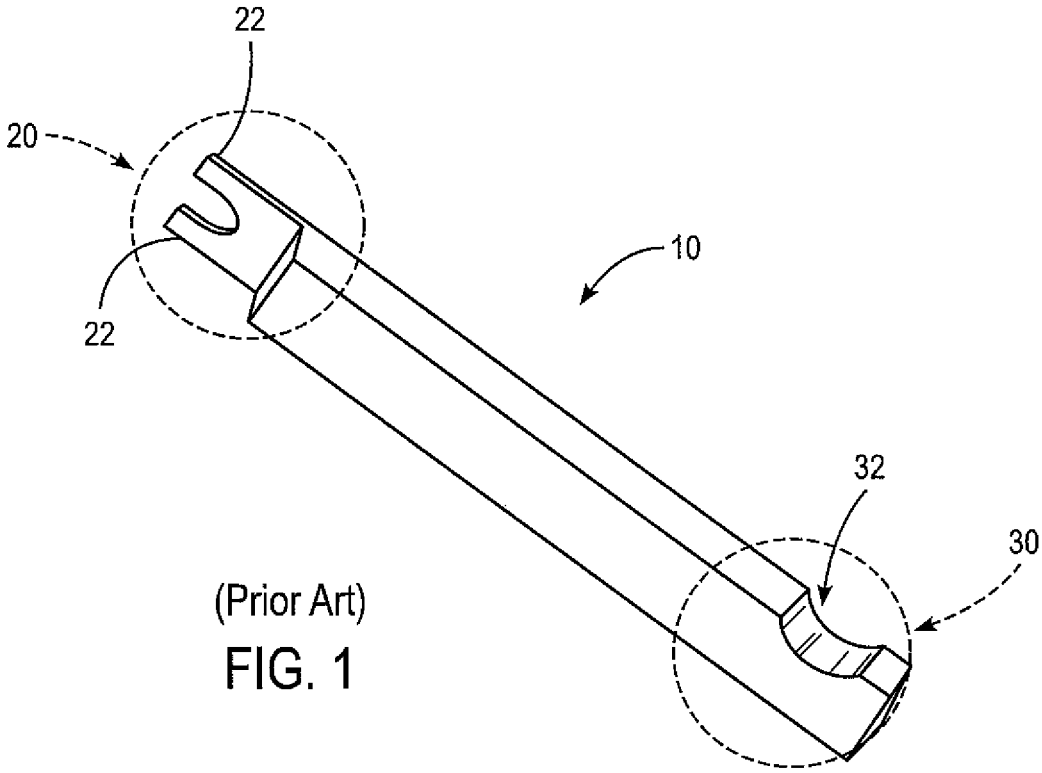
(Prior Art) FIG. 1
FIG. 1 illustrates a prior art installation and removal tool for installing and removing a c-clip.
Figure 2:
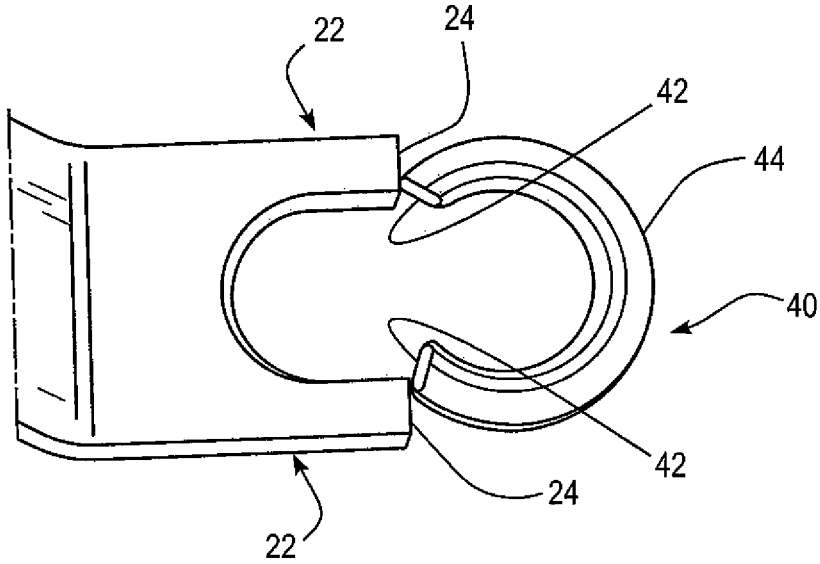
(Prior Art) FIG. 2
FIG. 2 illustrates the alignment of two prongs of a prior art installation and removal tool to a c-clip for removal.
Figure 3:
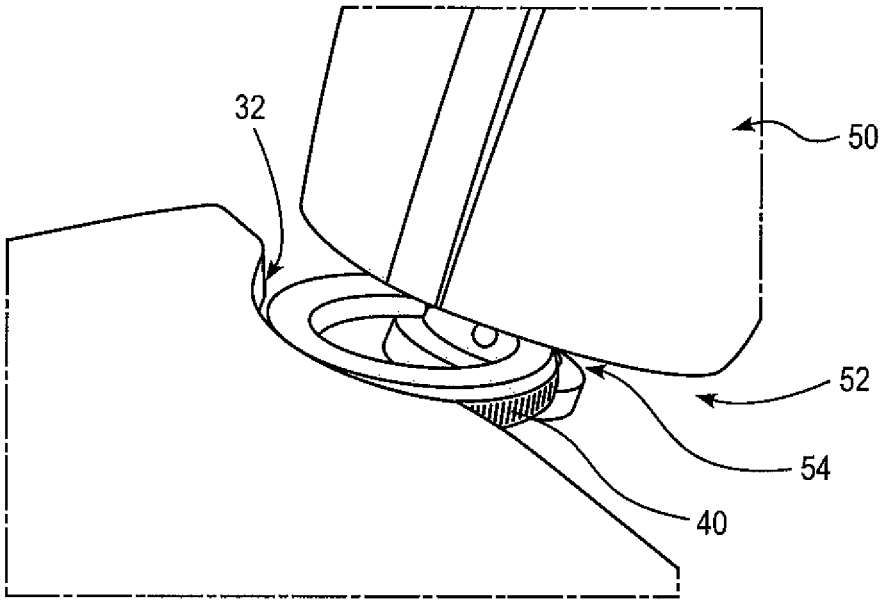
(Prior Art) FIG. 3
FIG. 3 illustrates the alignment of a recessed seating feature of a prior art installation and removal tool to a c-clip for installation.
Figure 4:
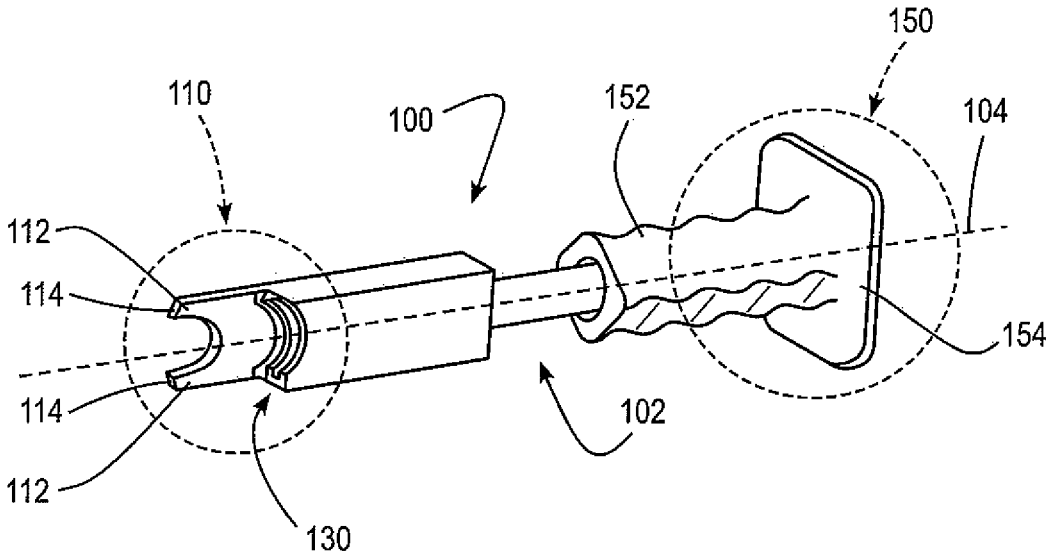
FIG. 4 shows a perspective view of an exemplary embodiment of an installation and removal tool.

An exemplary embodiment of an installation and removal tool is shown in FIG. 4. The tool 100 comprises a body 102 having a first end 110 and a second end 150 opposite each other along a longitudinal axis 104 of the tool 100. The first end 110 includes two prongs 112 for removal of a retaining clip 160, and a recessed seating feature 130 for installation of a retaining clip 160. The second end 150 comprises a handle 152, which includes a hand protector 154.

The installation and removal tool 100 helps remove the retaining clip 160 by aligning end surfaces 114 of the two prongs 112 of the tool with contact surfaces 162 of the retaining clip 160, followed by applying a longitudinal force, preferably by striking the second end 150 of the body of the tool with a hammer, to push the retaining clip 160 off of a groove 204 in a shank 202 of a tool pick 200. The installation and removal tool 100 helps install the retaining clip 160 by securely fitting the retaining clip within the recessed seating feature 130, which self-aligns the retaining clip 160 with the groove 204 in the shank 202, followed by applying a longitudinal force, preferably by striking the second end 150 of the body of the tool with a hammer, to push the retaining clip 160 onto the groove 204 of the shank.

The prongs 112, which typically are arranged in parallel relationship to each other, each include an end surface 114, for contacting a retaining clip 160 during a removal method. Each prong 112 further includes an inner side surface 116 facing toward the other prong, and an outer side surface 118 facing away from the other prong. The end surface 114 of each prong is non-orthogonal to the inner side surface 116 or outer side surface 118. Preferably, the end surface 114 is non-orthogonal to both the inner side surface 116 and the outer side surface 118. More preferably, the end surface and inner side surface form an acute angle ($\alpha$) at the point of intersection 120. This angle or orientation of the end surface 114 allows the end surface to correspond to the angle or orientation of the contacting surface 162 of a retaining clip that is contacted during removal. Such relationships are more clearly seen in FIG. 5, where separate features are given the designation a and b for clarity.

Figure 5:
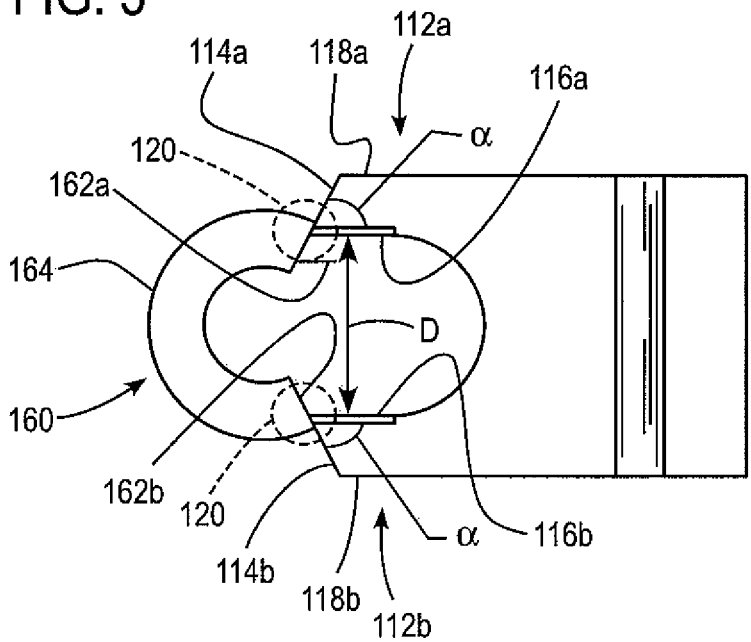
FIG. 5 shows a top view of a first end of an exemplary embodiment of an installation and removal tool, along with the alignment thereof with a retaining clip.

FIG. 5 shows an exemplary embodiment of the installation and removal tool 100 of the invention in contact with a retaining clip 160 in the form of a c-clip. The retaining clip 160 includes two contacting surfaces 162*a* and 162*b* (sometimes collectively referred to as 162) that come in contact with the two prongs 112 of the installation and removal tool during removal of the retaining clip 160 from the shank 202 of the tool pick. The distance between the prongs (D) is a distance sufficient to allow simultaneously a portion of an end surface 114*a* of a first prong 112*a* to contact a portion of a first contact surface 162*a* of the retaining clip and a portion of an end surface 114*b* of a second prong 112*b* to contact a portion of a second contact surface 162*b* of the retaining clip. The contact between the contacting surfaces 162 and the end surface 114 of each of the prongs is preferably surface contact. In the case where the contacting surfaces and the end surfaces are planar, the contact therebetween is preferably planar contact.

The portion of the end surface 114 of each prong contacting the contact surfaces of the retaining clip includes a region of the end surface closest to an inner side surface 116 facing the other prong or an outer side surface 118 facing away from the other prong. Also, the end surface 114 of each prong can be sized smaller or larger than the contact surfaces 162 of the retaining clip. If the end surface 114 of each prong is larger than the contact surfaces 162, the end surface of each prong can completely cover the contact surfaces of the retaining clip. If the end surface 114 of each prong is smaller than the contact surfaces 162, the contact surfaces of the retaining clip can completely cover the end surface of each prong. Similarly, the end surface of each prong and the contact surfaces of the retaining clip can have the same size, and be aligned so as to completely cover both surfaces.

The angle to the end surface of each prong makes it much easier for the end-user to align the two prongs with a retaining clip for removal. Because the angle of the end faces of the two prongs corresponds to the angle of the contact surfaces of the retaining clip, the tool self-aligns when used in removal.

If one contact surface 162 of the retaining clip receives substantially more force than the other contact surface, the retaining clip 160 tends to spin around the groove 204 in the shank as opposed to being removed. This problem is limited by the angle of the end surfaces 114, because the angle corresponding to the angle of the retaining clip provides a larger contact area between the tool and retaining clip so that the force is more evenly distributed to the retaining clip.

The recessed seating feature 130 is arranged in the first end 110 of the tool with the two prongs 112. The two prongs 112 protrude toward, and the recessed seating feature 130 opens toward, the first end 110 of the body of the tool. By positioning both the two prongs 112 and the recessed seating feature 130 on the same end and facing the same direction, the force applied to the tool in both installation and removal can be applied from the same direction. This allows the second end 150 of the body of the tool to be specifically designed for receiving the force, for example, with a hand hold or other attachment device. Also, by the recessed seating feature 130 being located and oriented to open toward the first end 110, the tool 110 accommodates easy installation from the right or left side of the tool pick 200.

Figure 6:
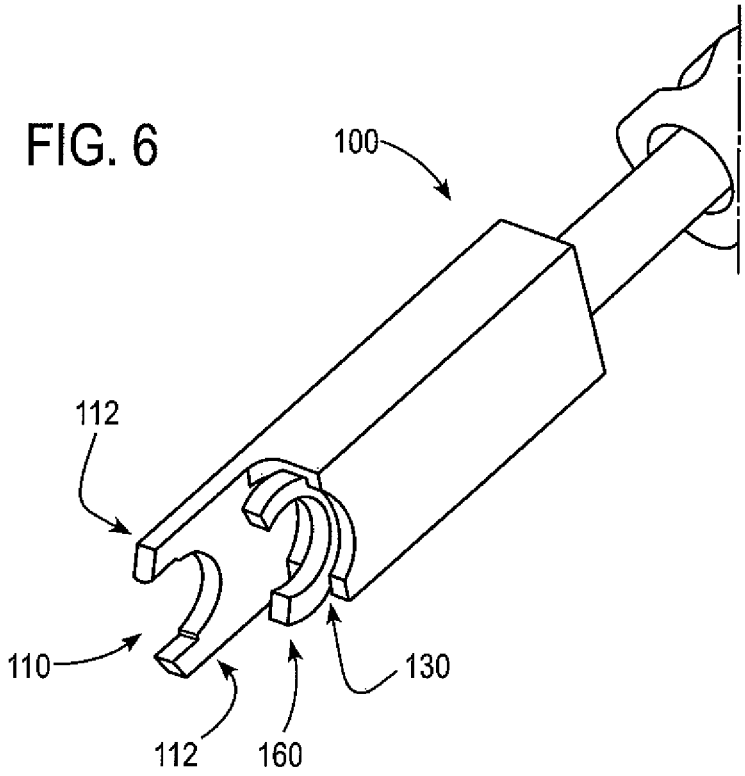
FIG. 6 shows a partial perspective view of an installation and removal tool with a retaining clip positioned in a recessed seating feature for installation.
Figure 7:
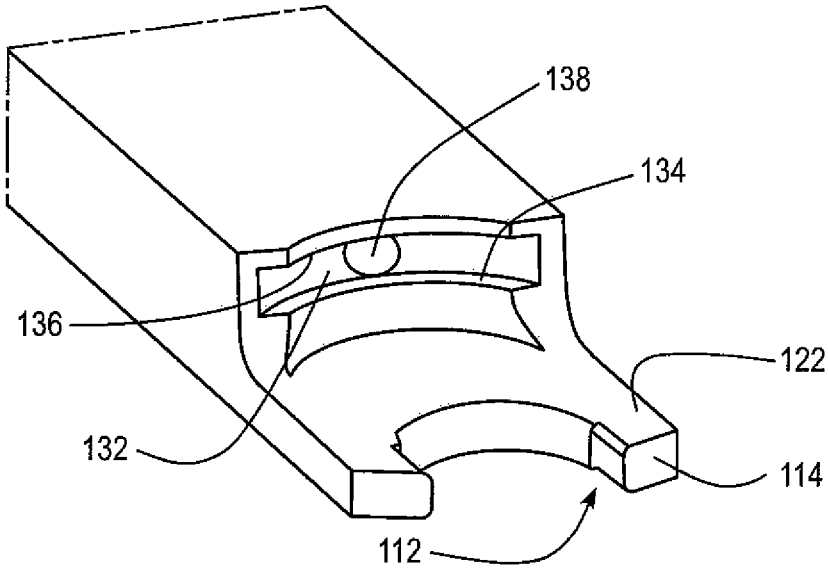
FIG. 7 shows a partial perspective view of the first end of the installation and removal tool, in which a magnet is located on the concave surface of the recessed seating feature.
Figure 10:
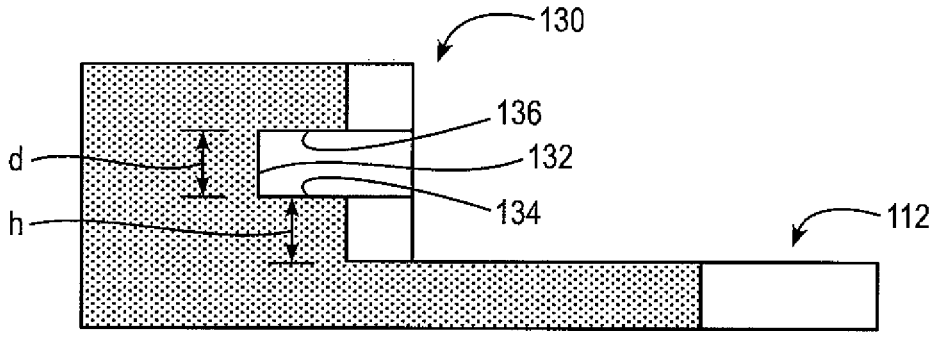
FIG. 10 shows a cross section of the first end of the body of the tool through the line A-A in FIG. 7.

The recessed seating feature 130 for installation of a retaining clip contains an upper surface 136 and lower surface 134 joined by a concave surface 132 recessed into the tool as exemplified in the close up perspective view in FIGS. 6-7 and the cross-sectional view in FIG. 10. The upper surface 136, lower surface 134, and concave surface 132 are shaped to geometrically correspond to the back region 164 of the retaining clip, for example, the region of the outer diameter opposite from the opening in the retaining clip between the contacting surfaces 162, so as to hold the retaining clip 160 firmly within the recessed seating feature 130 during installation. The concave surface 132 has a radius of curvature that is approximately the same as a radius of curvature of the retaining clip 160 to be installed on the tool pick 200. The upper surface 136 and lower surface 134 are separated by a distance (d) that is approximately the same as the thickness of the retaining clip 160. This geometric correspondence between the retaining clip 160 and recessed seating feature 130 makes alignment of the retaining clip 160 prior to striking it into place simple, easy, and safe.

Figure 8:
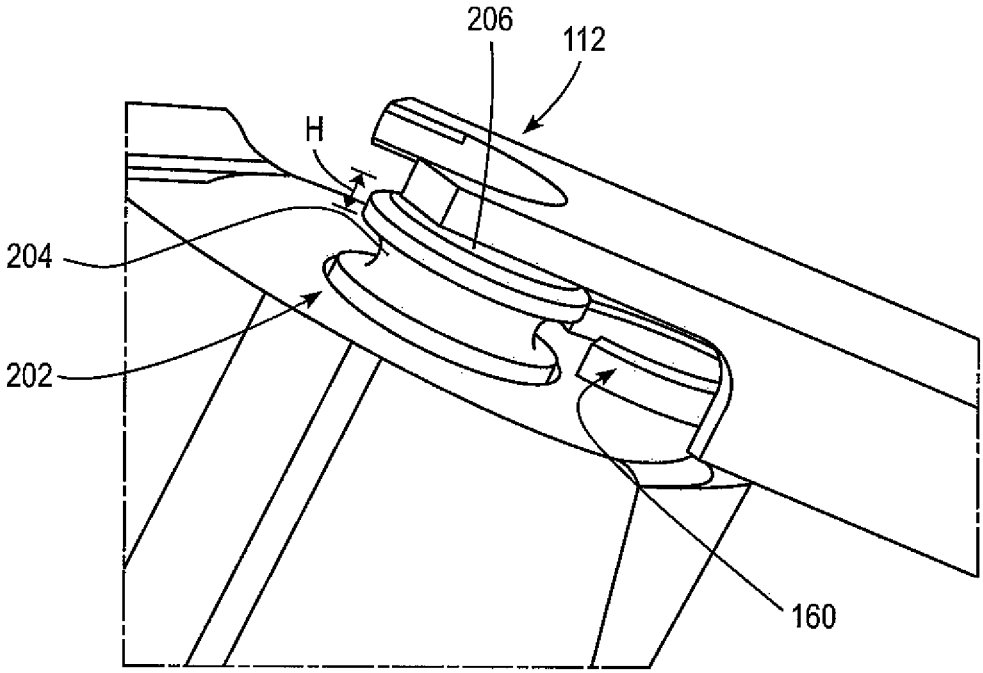
FIG. 8 shows an installation of a retaining clip to a tool pick utilizing an exemplary embodiment of the installation and removal tool.
Figure 9:
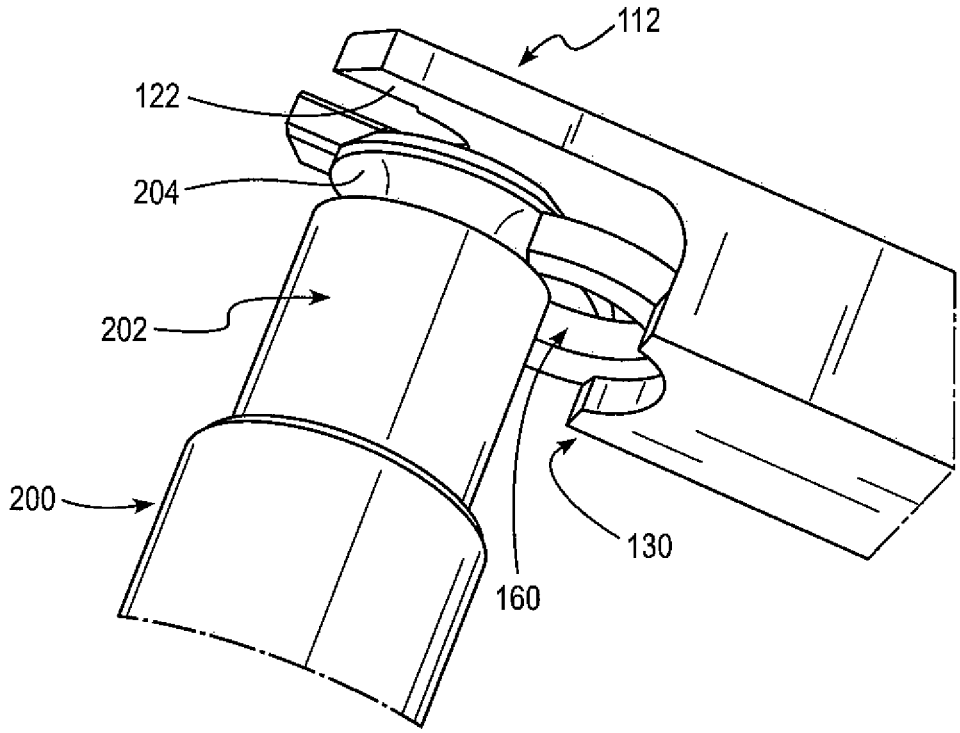
FIG. 9 shows another installation of a retaining clip to a different tool pick utilizing an exemplary embodiment of the installation and removal tool.

The recessed seating feature 130 and the two prongs 112 can be positioned in relation to each other so that the two prongs 112 act as a stop when installing the retaining clip 160, as shown in FIGS. 8 and 9. The recessed seating feature 130 is positioned closer to the second end 150 of the tool than the two prongs 112, and in a plane different from the plane containing both of the two prongs 112. The planes containing the recessed seating feature 130 and the two prongs 112 are separated by a distance (h) that is approximately the same as the distance (H) between the end 206 of the shank and the groove 204 in the shank of a tool pick 200. This positioning enables the retaining clip 160 secured within the recessed seating feature 130 to align with the groove 204 in the shank when the upper surfaces 122 of the two prongs are in contact with the end surface 206 of the shank. Furthermore, the two prongs 112 can serve as a support surface or shelf for the retaining clip itself while installing the retaining clip. The combination of the positioning of the recessed seating feature 130 in relation to the two prongs 112 and the secure fit of the retaining clip 160 within the recessed seating feature 130 enables precise self-alignment of the retaining clip 160 to the groove 204 in the shank for easier and safer installation.

As shown in FIG. 7, at least one magnet 138 may, optionally be added in the recessed seating feature 130 of the tool to provide a magnetic force to help hold the retaining clip in the recessed seating feature. The at least one magnet 138 is located at a position relative to the recessed seating feature 130 sufficient to hold a retaining clip 160 within the recessed seating feature 130. In particular, the at least one magnet 138 can be located on or slightly recessed into the concave surface 132 of the recessed seating feature 130. Preferably, the magnets 138 are placed in such a way that they do not come in direct contact with the retaining clip 160. This is accomplished by either placing the at least one magnet 138 inside the tool 100 behind the upper surface 136, lower surface 134, or concave surface 132, or a layer of chemical sealant can be used to protect the at least one magnet 138 from impact.

Further, as shown in FIG. 4, the second end 150 of the tool can include a handle 152 to enlarge the surface area for holding the tool 100, and for striking the second end 150 of the tool with a hammer. The handle 152 can include a hand protector 154 added as a safety feature for the end-user.

FIGS. 8 and 9 show exemplary embodiments of the shank 202 of a tool pick. The shank 202 includes a groove 204 about which a retaining clip 160 is positioned. The groove 204 is a particular distance (H) from the end surface 206 of the shank of the tool pick.

The retaining clip is typically a resilient clip having a c-shape, such as a c-clip, formed from spring steel, although any retaining clip can be used with an installation and removal tool having suitable featured curves precisely shaped to provide the features disclose herein. The retaining clip has dimensions that allow the ends to bend outwardly to get around the groove in the shank, and then snap tight against the groove when it is fully installed. To push the retaining clip onto the groove or to remove the retaining clip an installation and removal tool is used.

The installation and removal tool of the invention is especially useful in a system for installing or removing a retaining clip from a tool pick. FIGS. 8 and 9 show such a system wherein there is provided a tool pick, a retaining clip and an installation and removal tool. In both figures, the retaining clip is shown seated in the recessed seating feature of an installation and removal tool immediately prior to a force being applied to the second end of the tool, preferably with a hammer, to drive the resilient retaining clip onto the groove of the shank of the tool pick.

The retaining clip can be removed from the groove in the shank, by aligning the end surfaces of the two prongs of the tool with the contact surfaces of the retaining clip immediately prior to a force being applied to the second end of the tool to drive the resilient retaining clip off of the groove in the shank.

Although described in connection with preferred embodiments thereof, it will be appreciated by those skilled in the art that additions, deletions, modifications, and substitutions not specifically described may be made without departure from the spirit and scope of the invention as defined in the appended claims.

What is claimed is:

1. An installation and removal tool for installing and removing a retaining clip, comprising:

a body including a first end and a second end, wherein the first end includes:

two prongs separated by a distance, and a recessed seating feature, and wherein the recessed seating feature includes an upper surface and a lower surface joined by a concave surface recessed into the body of the tool, wherein the recessed seating feature is contained in a different plane than a plane containing both of the two prongs, wherein the plane containing both of the two prongs is at a distance from the plane containing the recessed seating feature that is approximately equal to a distance between a groove and an end surface of a shank of a tool pick to which the retaining clip is installed, wherein an end surface of each prong is non-orthogonal to an inner side surface facing the other prong or an outer side surface facing away from the other prong, and wherein a shape or an orientation of the end surface corresponds to a shape or orientation of a contact surface of the retaining clip to be removed.

2. The installation and removal tool according to claim 1, wherein the distance between the two prongs is such that simultaneously a portion of an end surface of a first prong contacts a portion of a first contact surface of the retaining clip, and a portion of an end surface of a second prong contacts a portion of a second contact surface of the retaining clip.

3. The installation and removal tool according to claim 1, wherein the recessed seating feature is located longitudinally closer to the second end than are the two prongs.

4. The installation and removal tool according to claim 1, further comprising at least one magnet located at a position relative to the recessed seating feature sufficient to hold a retaining clip within the recessed seating feature.

5. The installation and removal tool according to claim 4, wherein the magnet is recessed into the concave surface and does not directly contact the retaining clip.

6. The installation and removal tool according to claim 1, wherein the end surface and inner side surface form an acute angle at the point of intersection.

7. The installation and removal tool according to claim 1, wherein an inlet of the recessed seating feature opens toward the first end of the body of the tool, and wherein the two prongs protrude toward the first end of the body of the tool.

8. The installation and removal tool according to claim 1, wherein a radius of curvature of the concave surface of the recessed seating feature is approximately the same as a radius of curvature of the retaining clip to be installed.

9. A tool pick retaining clip installation and removal system comprising:

a retaining clip to fit within a groove in a shank of a tool pick, and an installation and removal tool for installing and removing the retaining clip from the groove comprising:

a body including a first end and a second end, wherein the first end includes:

two prongs separated by a distance, and a recessed seating feature, wherein the distance between the two prongs is such that simultaneously a portion of an end surface of a first prong contacts a portion of a first contact surface of the retaining clip, and a portion of an end surface of a second prong contacts a portion of a second contact surface of the retaining clip, wherein the recessed seating feature includes an upper surface and a lower surface joined by a concave surface recessed into the body of the tool, wherein the distance between the upper and lower surfaces is approximately the same as the thickness of the retaining clip, and wherein the recessed seating feature is contained in a different plane than a plane containing both of the two prongs.

10. The system according to claim 9, further comprising a tool pick including a shank with a groove therein, wherein a surface of both of the two prongs contacts the end surface of the tool pick when the retaining clip positioned in the recessed seating feature is aligned with the groove.

11. The system according to claim 9, wherein the portion of the end surface of each prong contacting the contact surfaces of the retaining clip includes a region of the end surface closest to an inner side surface facing the other prong.

12. The system according to claim 11, further comprising a tool pick including a shank with a groove therein, wherein a surface of both of the two prongs contacts the end surface of the tool pick when the retaining clip positioned in the recessed seating feature is aligned with the groove.

13. The system according to claim 9, wherein the end surface of each prong is non-orthogonal to an inner side surface facing the other prong or an outer side surface facing away from the other prong.

14. The system according to claim 13, further comprising a tool pick including a shank with a groove therein, wherein a surface of both of the two prongs contacts the end surface of the tool pick when the retaining clip positioned in the recessed seating feature is aligned with the groove.

15. The system according to claim 9, wherein an inlet of the recessed seating feature opens towards the first end of the body of the tool, and wherein the two prongs protrude towards the first end of the body of the tool.

16. The system according to claim 15, further comprising a tool pick including a shank with a groove therein, wherein a surface of both of the two prongs contacts the end surface of the tool pick when the retaining clip positioned in the recessed seating feature is aligned with the groove.

17. The system according to claim 9, further comprising at least one magnet located at a position relative to the recessed seating feature sufficient to hold a retaining clip within the recessed seating feature, and wherein the magnet is recessed into the concave surface and does not directly contact the retaining clip.

* * * * *